United States Patent [19]

Sato

[11] 4,361,087

[45] Nov. 30, 1982

[54] PRINTING POSITION ADJUSTING MECHANISM FOR PRINTERS

[75] Inventor: Yo Sato, Tokyo, Japan

[73] Assignee: Kabushiki Kaisha Sato, Japan

[21] Appl. No.: 238,574

[22] Filed: Feb. 26, 1981

[30] Foreign Application Priority Data

Feb. 29, 1980 [JP] Japan ..... 55-25048[U]

[51] Int. Cl.[3] ..... B41J 1/60

[52] U.S. Cl. ..... 101/109; 101/110; 101/111

[58] Field of Search ..... 101/109, 110, 111, 106, 101/291, 298; 400/59

[56] References Cited

U.S. PATENT DOCUMENTS

| | | | |
|---|---|---|---|
| 1,123,561 | 1/1915 | Lorenz | 400/59 X |
| 3,724,367 | 4/1973 | Pasinski | 101/110 |
| 4,018,157 | 4/1977 | Sato | 101/110 |
| 4,051,780 | 10/1977 | Sato | 101/298 X |
| 4,170,938 | 10/1979 | Sato | 101/111 |
| 4,179,989 | 12/1979 | Sato | 101/291 |

FOREIGN PATENT DOCUMENTS

| | | | |
|---|---|---|---|
| 848507 | 9/1952 | Fed. Rep. of Germany | 101/110 |
| 574933 | 7/1924 | France | 101/110 |
| 52-64229 | 5/1977 | Japan | 400/59 |

*Primary Examiner*—Edgar S. Burr
*Assistant Examiner*—Moshe I. Cohen
*Attorney, Agent, or Firm*—Ostrolenk, Faber, Gerb & Soffen

[57] ABSTRACT

A printing position adjusting mechanism is disclosed for use in a printer of the type in which a printing head is carried on the leading end portion of a yoke and the row of types of the printing head is arranged in the longitudinal direction of the yoke. The printing position adjusting mechanism includes an externally threaded adjusting ring, which is screwed into the internally threaded hole formed in the front frame plate of the yoke, and its leading end face abuts the opposed leading end face of the yoke. This causes the printing head to be moved longitudinally of the yoke, thereby to adjust the printing position thereof relative to the yoke. For fixing the printing head at a desired printing position to the yoke, an internally threaded hole is formed in the leading end face of the yoke, and a fixing screw is inserted into a center hole through the adjusting ring and extends into the threaded hole in the yoke. Thus, the printing position can be adjusted reliably with ease merely by screwing the adjusting ring in the threaded hole in the printing head.

16 Claims, 4 Drawing Figures

PRINTING POSITION ADJUSTING MECHANISM FOR PRINTERS

BACKGROUND OF THE INVENTION

1. Field of the Invention

The present invention relates to a printer, such as a portable label printing and applying device (referred to hereinafter as a "hand labeler") or a table-type label printing device, and more particularly relates to a printing means position adjusting mechanism for use with the printer.

2. Description of the Prior Art

In a known hand labeler, the printing head is usually attached to the leading end portion of a yoke, and each row of types is arranged to extend along a direction perpendicular to the longitudinal direction of the yoke. One adjusting means for adjusting the printing position of the printing head over the surfaces the labels comprises the printing head being slidably attached to the inner sides of the arms of a bifurcated yoke and the printing head being fixed at a suitable position to the yoke by fixing means, such as screws, extending into the frame plates, i.e., the side plates of the printing head, from the outside of the yoke.

For printing special labels, a hand labeler has recently been used in which the printing head is attached to the yoke at an orientation that is rotated over a right angle from the aforementioned direction, so that its type row extends in the longitudinal direction of the yoke. In this arrangement, however, the type surfaces of the type bands or type rings are exposed and extend up along the outside sides of the printing head. As a result, the outside of the printing head cannot be slidably attached to the yoke. Furthermore, fixing means such as threaded holes cannot be formed in the sides of the printing head. This prevents adjustment of the printing position which causes inconvenience.

SUMMARY OF THE INVENTION

It is therefore an object of the present invention to provide a printing position adjusting mechanism for use in a printer, which is made free from the aforementioned drawbacks of the prior art.

Another object of the present invention is to provide a printing position adjusting mechanism for adjusting the longitudinal printing position of a printer which includes a printing head attached to have its type row extending in the longitudinal direction of the yoke.

The present invention provides a printing position adjusting mechanism for use in a printer that includes a movable yoke and a printing head carried on the leading end portion of the yoke in a longitudinally slidable manner. The type row of the printing head extends in the longitudinal direction of the yoke. The printing position adjusting mechanism comprises an adjusting member having its outer circumference formed with external threads. When the adjusting member is screwed into an internally threaded hole in the front frame plate of a printing head carried on the movable yoke, this brings the rearward end face of the adjusting member into abutment engagement with the opposed forward or leading end face of the movable yoke. The printing head may be moved longitudinally of the yoke to adjust its printing position relative to the yoke. There are means for fixing the printing head to the yoke at a desired printing position.

BRIEF DESCRIPTION OF THE DRAWINGS

Other objects and features of the present invention will become apparent from the following description taken in conjunction with the accompanying drawings, in which.

DESCRIPTION OF A PREFERRED EMBODIMENT

Figure 3:
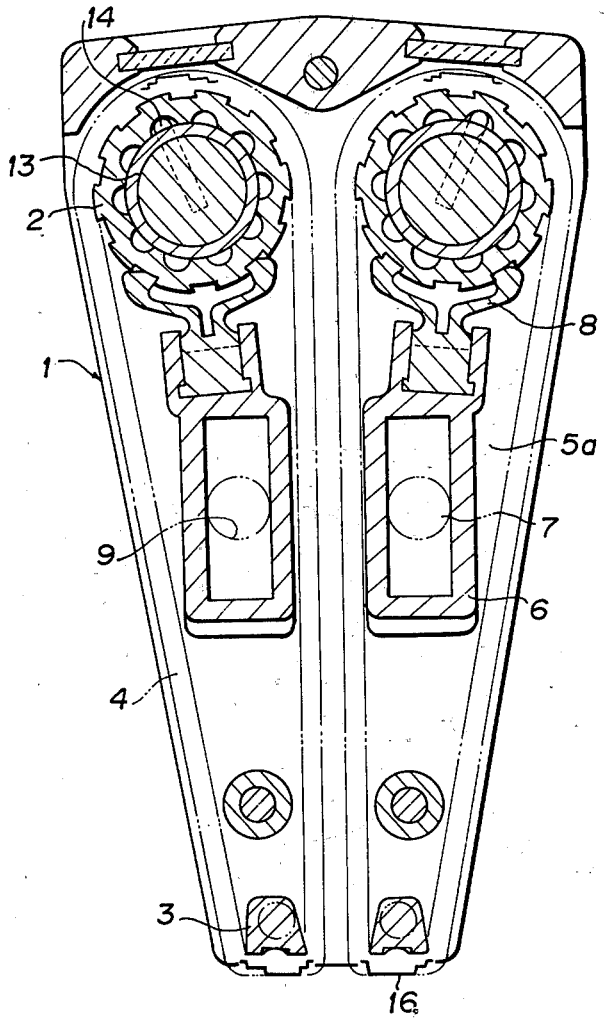
FIG. 3 is a longitudinal section of the printing head, taken along line III—III of FIG. 2.

These accompanying drawings show the invention in association with a printer such as a hand labeler. The invention may be used with any other printer using an adjustable printing head. A printing head 1 used in the printer is of the dual type, having two type rows. It is bisymmetric, as shown in FIG. 3. Each of the type rows is comprised of a plurality of endless type bands 4 which run under tension around both a plurality of upper rotary rings 2 and a plurality of lower supports 3. The printing head 1 has a center portion which is formed with a pair of yoke receptacles 6 which are integral with a rear (right in FIG. 1) frame plate 5*a* of the center portion, and the yoke receptacles 6 are formed with sliding holes 7. The upper portion of the printing head 1 includes a pair of positioning members 8 made of elastic material and each is for positioning a respective rotary ring 2.

Figure 1:
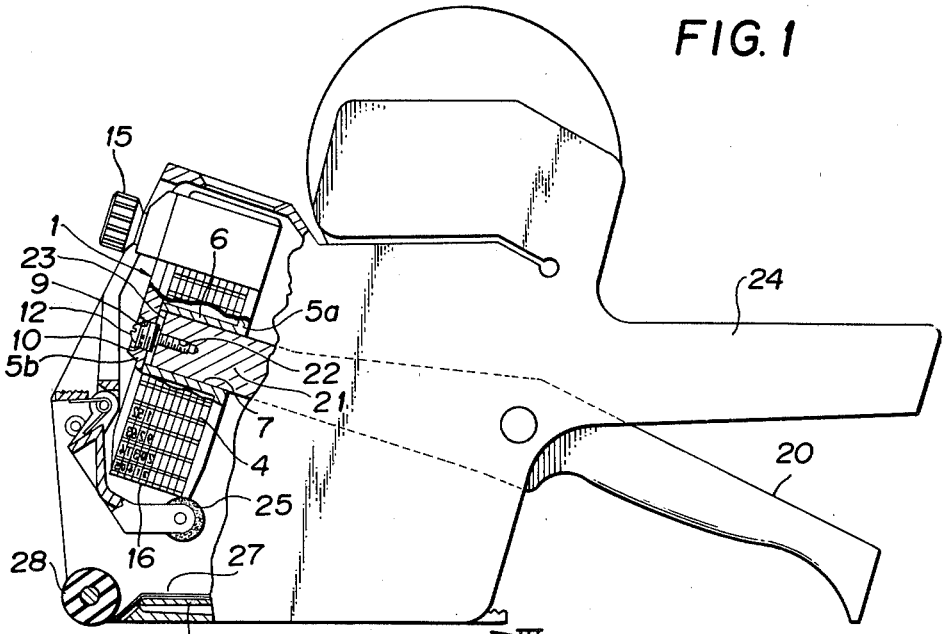
FIG. 1 is a side elevational view showing the overall construction of a hand labeler, to which the present invention is applied.
Figure 2:
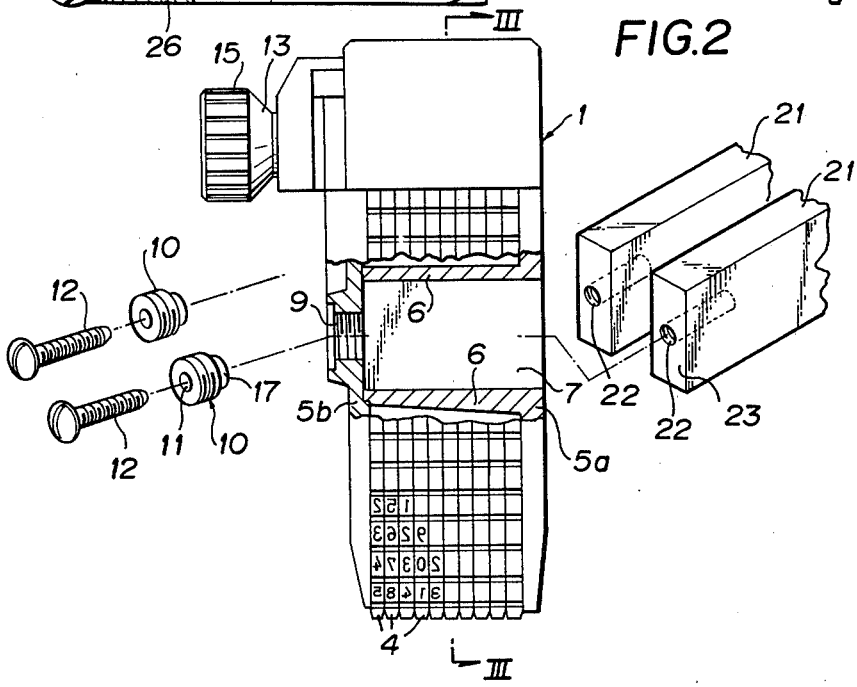
FIG. 2 is a partially side elevational and a partially perspective view showing the printing head and adjacent components of the labeler.

As shown in FIG. 2, each of the sliding holes 7 has one end which is opened with sufficient width to slidably receive each branch of a bifurcated yoke 21. The other ends of both holes 7 are covered with the other front (left in FIG. 1) frame plate 5*b*. The frame plate 5*b* includes a pair of internally threaded through holes 9 of small diameter. A pair of adjusting members or rings 10, each of which is formed on its outer circumference with external threads and at its center with a through hole 11, are screwed into the respective threaded holes 9. A fastener comprising a fixing screw 12 is inserted into the through holes 11 of each adjusting ring 10.

The printing head 1 is a well-known type selecting mechanism, including a selecting shaft 13 having its leading end formed with an engaging tooth 14 and its other end equipped with a selecting knob 15, which is arranged rotatably and axially slidably in the center bores of the plural rotary rings 2 of each type row. See, for instance, U.S. Pat. Nos. 4,170,938 and 4,179,989.

The bifurcated yoke 21 is integral with the actuating lever 20 of the hand labeler, and the two branches of the yoke are sized to be slidably fitted in the sliding holes 7. The leading or forward end faces 23 of the yoke branches have a pair of threaded holes 22 formed in them, into which the fixing screws 12 are to be screwed.

Figure 4:
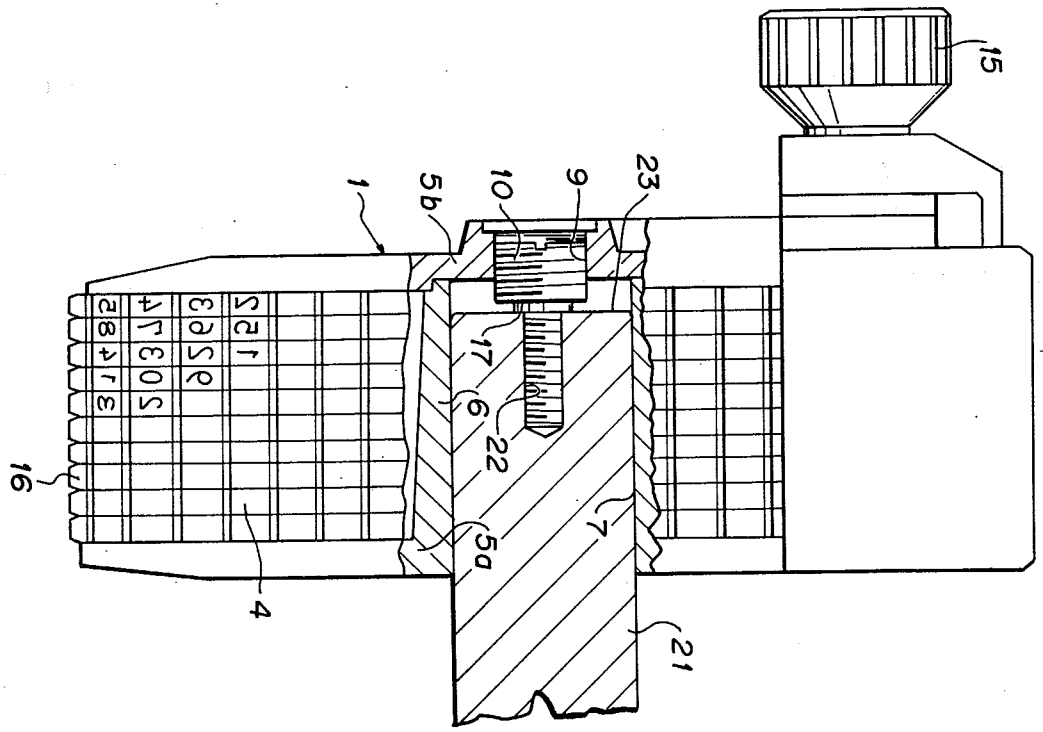
FIG. 4 is a partially cut-away side elevational view of a printing head showing the condition under which the printing position is being adjusted.

The operations of the printing position adjusting mechanism according to the present invention is now described. To mount the printing head 1 on the bifurcated yoke 21, the branches of the yoke 21 are inserted into the sliding holes 7 of the printing head 1 until their leading end faces 23 abut against the inner, rearwardly facing walls of the front frame plate 5*b* of the printing head 1. Then, one of the adjusting rings 10 is screwed into the corresponding threaded hole 9 of the frame plate 5*b*using a driver, or the like. After the leading end face 17 of the adjusting ring 10 has abutted against the opposed leading end face 23 of the corresponding branch of the yoke 21, the adjusting ring 10 is prevented from entering any further by the abutment engagement with the yoke 21. As a result, the printing head 1, into which the adjusting ring 10 has been screwed, is moved as a whole relative to that particular adjusting ring 10 as the ring is screwed in further. As better seen from FIG. 4, the inner wall of the frame plate 5*b* of the printing head 1 separates from the leading end faces 23 of the yoke 21 and the printing head 1 is moved to the front of the hand labeler thereby. This shifts the type bands 4 and thus the printing locations on the label surfaces to be imprinted.

The adjusting operation described above is interrupted when the desired printing position is reached. Then, another adjusting ring 10 is screwed into the other corresponding threaded hole 9 until the second ring 10 takes the same position as the first ring 10. The fixing screws 12 are next inserted into the through holes 11 of the adjusting rings 10, and their leading end portions are screwed into the threaded holes 22 of the yoke 21, thereby to fix the printing head to the yoke 21 at the desired printing position through the adjusting rings 10.

After the printing position has been set in that way, the labels are consecutively printed and applied by the ordinary operations of the hand labeler. Referring to FIG. 1, the printing head 1 and the yoke 21 are moved down together by squeezing of the actuating lever 20 toward a grip 24. As the printing head descends, an inking roller 25 is made to turn on the lowermost ends of the type bands 4, thereby to apply ink to those type surfaces 16 which are positioned on the lowermost ends at that time. Continued descent of the printing head brings the type surfaces 16 to stamp and print the label 27 which is then positioned on a platen 26. When the actuating lever 20 is therafter released, the printing head 1 is lifted apart from the platen 26, and the printed label 27 is conveyed to below an applying roller 28 by the action of a feeding mechanism (not shown), which is mounted in the hand labeler, so that the label can be applied to an article. See this structure and operation in U.S. Pat. No. 4,051,780.

To change the printing position of the type surfaces along the labels, only the fixing screws 12 are first loosened and removed. This frees the printing head 1 to slide relative to the yoke 21. If one of the adjusting rings 10 is then screwed forward (to the right in FIG. 1) or backward, as desired, by means of a driver or the like, the printing head 1 is moved correspondingly forward and backward relative to that particular adjusting ring 10. When the printing head 1 has moved to the desired printing position, the screwing operation of that adjusting ring 10 is interrupted. The other adjusting ring 10 is likewise screwed to the same position as the first adjusting ring 10. After that, the adjusting rings 10 and the printing head 1 are again fixed to the yoke 21 by means of the respective fixing screws 12, thus finishing the adjusting operation.

Although the fixing screws 12 fix the printing head 1 to the yoke 21 in an indirect manner, i.e., through the adjusting members 10, the present invention contemplates directly fixing the printing head 1 to the yoke, at positions different from the adjusting members 10, by means of fixing screws, or the like.

Moreover, the present invention can be applied to another construction, in which the printing head is of the well-known type-carrying ring type (see U.S. Pat. No. 4,018,157), as well as the above described type-carrying band type.

The present invention has been applied to a printer in which the printing head is attached to the yoke in a manner to have the type row arranged along the longitudinal direction of the yoke. Therefore, the present invention can enjoy an excellent practical effect that the printing position of the labels or the like by the printing head can be adjusted reliably with ease merely by screwing the adjusting member in the threaded hole in the printing head. But, the invention could as easily be used with a printing head wherein the rows of types extend transversely of the longitudinal direction of the yoke.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Printing position adjusting mechanism for use in a printer, wherein the printer comprises:

a platen; a yoke movable with respect to the platen toward and away from the platen, the yoke having a leading end portion with leading end faces thereon; and a printing head carried on the leading end portion of the yoke for moving together with the yoke with respect to the platen; the printing head having types supported thereon and facing toward the platen such that relative movement of the yoke toward the platen moves the types to the platen for printing an object then supported on the platen;

the printing position adjusting mechanism comprising:

an adjusting member supported on the printing head and movable with respect thereto in directions toward and away from the leading end faces of the yoke; the adjusting member having an abutment face opposed to the leading end faces of the yoke, whereby following selected movement of the adjusting member with respect to the printing head, the printing head can be adjusted in position with respect to the yoke until the adjusting member abutment face abuts the leading end faces of the yoke.

2. The printing position adjusting mechanism of claim 1, wherein the yoke has a longitudinal direction of extension, and the leading end portion of the yoke is toward one end of the yoke; means for guiding the printing head to be adjustable along the longitudinal direction of extension of the yoke until the adjusting member abutment face abuts the leading end faces of the yoke.

3. The printing position adjusting mechanism of claim 2, wherein the types are arranged in a row and the row thereof extends in the longitudinal direction of the yoke.

4. The printing position adjusting mechanism of either of claims 1 or 2, further comprising fixing means for fixing the printing head to the yoke for preventing further adjusting movement of the printing head with respect to the yoke.

5. The printing position adjusting mechanism of claim 4, wherein the fixing means comprises a fastener extending from the printing head to the yoke.

6. The printing position adjusting mechanism of claim 5, wherein the fixing means comprises a screw extending to the yoke and the yoke having a threaded opening therein for receiving the screw.

7. The printing position adjusting mechanism of claim 6, wherein the fixing means comprises a screw extending through the adjusting member for engaging the adjusting member, and the yoke having a threaded opening therein for receiving the screw.

8. The printing position adjusting mechanism of claim 5, wherein the fastener extends from the adjusting member to the yoke.

9. The printing position adjusting mechanism of claim 8, wherein the fastener comprises a screw extending to the yoke and the yoke having a threaded opening therein for receiving the screw.

10. The printing position adjusting mechanism of either of claims 1 or 2, wherein the adjusting member is screw threadedly connected to the printing head, and the adjusting member is moved to move the abutment face with respect to the leading end faces of the yoke by being screwed into different positions.

11. The printing position adjusting mechanism of claim 10, wherein the types are arranged in a row and the row thereof extends in the longitudinal direction of the yoke.

12. The printing position adjusting mechanism of claim 10, further comprising fixing means for fixing the printing head to the yoke for preventing further adjusting movement of the printing head with respect to the yoke.

13. The printing position adjusting mechanism of claim 10, wherein the adjusting member is screw threadedly connected to the printing head in that the adjusting member has an externally threaded circumference and the printing head includes an internally threaded screw hole for receiving the adjusting member circumference.

14. The printing position adjusting mechanism of claim 10, further comprising a fastener extending from the adjusting member to the yoke for preventing further adjusting movement of the printing head with respect to the yoke.

15. The printing position adjusting mechanism of claim 14, wherein the fastener comprises a screw extending to the yoke and the yoke having a threaded opening therein for receiving the screw.

16. The printing position adjusting mechanism of claim 14, wherein the fastener comprises a screw extending through the adjusting member for engaging the adjusting member and the yoke having a threaded opening therein for receiving the screw.

* * * * *